US011317740B2

(12) United States Patent
Roberts et al.

(10) Patent No.: US 11,317,740 B2
(45) Date of Patent: May 3, 2022

(54) CLIP-ON ADAPTOR FOR INVENTORY DIVIDER

(71) Applicant: LogiQuip LLC, Galesburg, MI (US)

(72) Inventors: Mark Roberts, Galesburg, MI (US); Kevin Langston, Galesburg, MI (US)

(73) Assignee: LogiQuip LLC, Galesburg, MI (US)

( * ) Notice: Subject to any disclaimer, the term of this patent is extended or adjusted under 35 U.S.C. 154(b) by 0 days.

(21) Appl. No.: 17/166,638

(22) Filed: Feb. 3, 2021

(65) Prior Publication Data

US 2022/0007855 A1 Jan. 13, 2022

Related U.S. Application Data

(63) Continuation-in-part of application No. 16/924,980, filed on Jul. 9, 2020, now Pat. No. 10,973,318.

(51) Int. Cl.
*A47F 5/00* (2006.01)
*A47B 57/58* (2006.01)

(52) U.S. Cl.
CPC ..... *A47F 5/0056* (2013.01); *A47B 57/581* (2013.01); *A47B 2230/0003* (2013.01); *A47B 2230/07* (2013.01)

(58) Field of Classification Search
CPC ..... A47B 57/581; A47B 2230/0003; A47B 2230/07; A47B 96/021; A47B 96/04; A47B 57/06; A47B 55/02; A47B 47/00; A47F 5/005; A47F 5/01
See application file for complete search history.

(56) References Cited

U.S. PATENT DOCUMENTS

| | | | | |
|---|---|---|---|---|
| 2,654,307 | A | 10/1953 | Nisenson | |
| 3,750,894 | A | 8/1973 | Jensen et al. | |
| 4,190,167 | A | 2/1980 | Wells | |
| 4,927,033 | A * | 5/1990 | Patera | A47F 5/083 211/41.9 |
| 5,344,029 | A | 9/1994 | Oghia | |
| 5,351,837 | A | 10/1994 | Smith | |
| 5,480,035 | A | 1/1996 | Smith | |
| 6,023,024 | A | 2/2000 | Stjerneby | |
| 6,390,310 | B1 | 5/2002 | Insalaco | |
| 6,431,377 | B1 | 8/2002 | Lechman | |
| 7,682,465 | B2 | 3/2010 | Anderson | |
| 7,931,155 | B2 * | 4/2011 | Bastuji | A47L 15/503 211/41.9 |
| 7,984,812 | B2 * | 7/2011 | Pike | A47L 15/503 211/41.9 |
| 8,042,559 | B2 | 10/2011 | Choi | |
| 8,757,419 | B2 | 6/2014 | Schessi | |
| 9,326,604 | B1 | 5/2016 | Schuldt et al. | |
| 9,603,485 | B2 | 3/2017 | Hopkins | |
| 2003/0189018 | A1 | 10/2003 | Hopkins | |
| 2005/0109378 | A1 * | 5/2005 | Landsiedel | A47L 15/14 134/135 |
| 2007/0240698 | A1 | 10/2007 | Holbrook | |

* cited by examiner

*Primary Examiner* — Ko H Chan
(74) *Attorney, Agent, or Firm* — Gunther Evanina; Butzel Long

(57) ABSTRACT

An adaptor for facilitating mounting of a shelf divider for pivoting around an axis perpendicular to uniformly spaced apart wires of a shelf include a frame having side members that are fixedly spaced apart, an axle extending between the side members on which a shelf divider can be pivotably mounted, and snap-fit connectors configured to releasably secure the adaptor onto spaced apart parallel wires of a wire shelf.

13 Claims, 4 Drawing Sheets

CLIP-ON ADAPTOR FOR INVENTORY DIVIDER

CROSS-REFERENCE TO RELATED APPLICATIONS

This application is a continuation-in-part of U.S. application Ser. No. 16/924,980, filed Jul. 9, 2020 and is incorporated herein by reference in its entirety.

FIELD OF THE DISCLOSURE

This disclosure relates generally to inventory management, and more particularly to pivotable dividers used on wire-shelves to separate a primary stock from a reserve stock and to facilitate access to the reserve stock when the primary stock is depleted.

BACKGROUND OF THE DISCLOSURE

U.S. Pat. No. 9,326,604, incorporated in its entirety, discloses an inventory system including a pivoting divider mountable to wires of a shelf. The divider can be mounted for rotation around two perpendicular horizontal axes for wire mesh shelf units having a first set of uniformly spaced apart parallel wires and a second set of uniformly spaced apart parallel wires oriented perpendicularly to the first set of wires. However, many wire shelfs are comprised primarily of only one set of uniformly spaced apart parallel wires with only one or a small number of widely spaced apart cross wires which do not facilitate mounting of the divider for pivoting around an axis coincident or parallel with the cross-wire(s).

SUMMARY OF THE DISCLOSURE

Disclosed is an adaptor for use with a divider that is pivotable around a wire of a wire shelf, wherein the adaptor facilitates pivoting of the divider around an axis that is substantially perpendicular to parallel wires of the wire shelf. The adaptor includes a frame defined by spaced apart side members, an axle extending between the side members, and snap-fit connectors configured to releasably secure the adaptor onto spaced apart parallel wires of a wire shelf.

DETAILED DESCRIPTION

Figure 1:
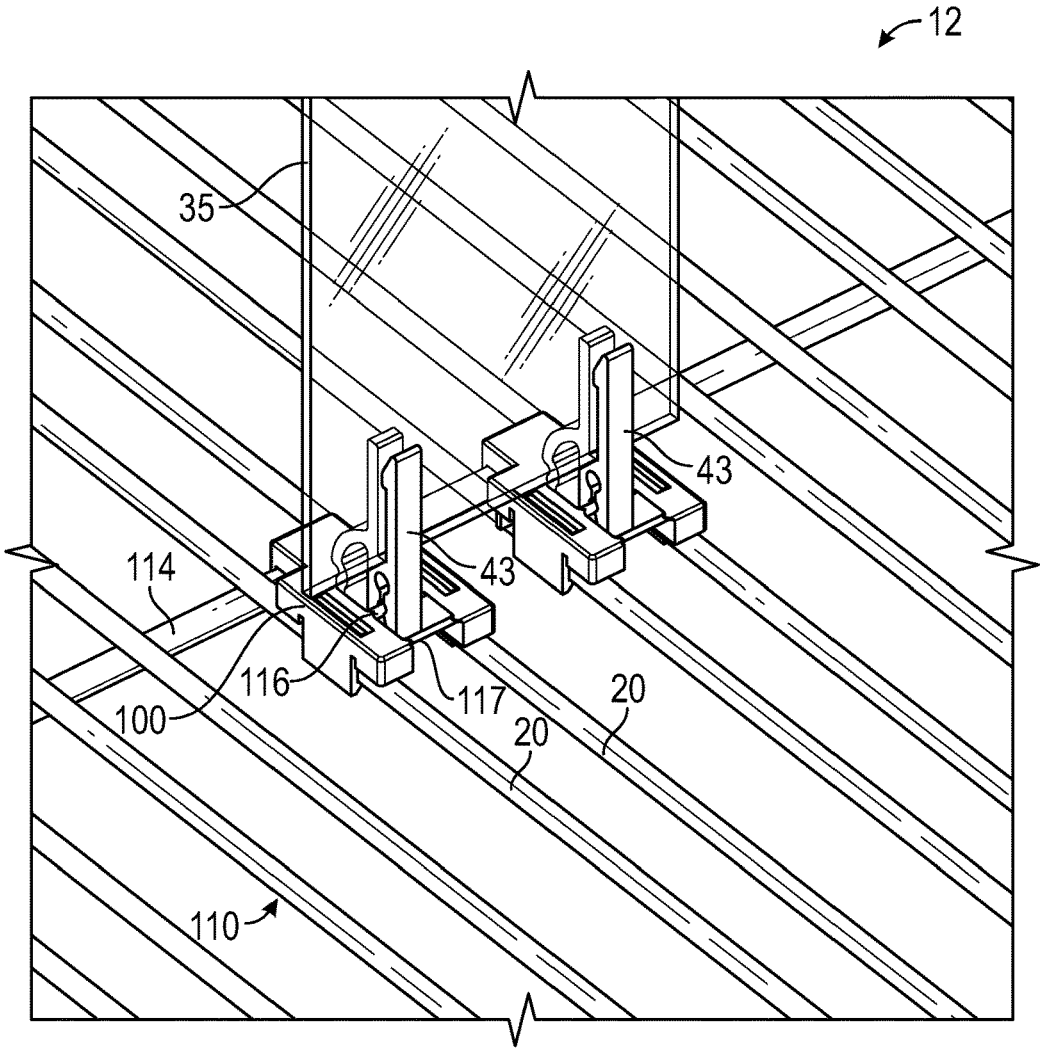
FIG. 1 is a perspective view of an inventory system having a wire shelf, a hinge clip to facilitate pivoting of a shelf divider between an upright position and lowered position, and an adaptor for facilitating pivoting of the divider around an axis perpendicular to parallel uniformly spaced wires of a wire shelf.

Adaptor 100 is configured to be secured onto adjacent wires of a wire shelf 110 comprising a plurality of closely spaced parallel wires 20 and a cross-wire 114. Adaptor 100 presents two parallel simulated wires 116, 117 that are spaced apart the same distance as the spacing between wires 20 of wire shelf 110. When secured to the wire shelf, the simulated wires 116, 117 are substantially perpendicular to the wires 20. Adaptor 100 allows hinge clips 43 to be used with a plate-like panel unit (or divider) 35 to form a divider unit 12 that facilitates pivoting of the divider unit around an axis perpendicular to parallel wires 20.

A detailed description of the divider unit and its use in inventory management is provided in U.S. Pat. No. 9,326,604, assigned to LogiQuip, LLC, Galesburg, Mich. Hinge clip 43 and divider unit 12 will be described with respect to use without the adaptor 100, it being understood that when used with adaptor 100, hinge clip 43 is mounted for rotation on simulated wire 116 rather than wire 20, and that a locking formation 61 engages simulated wire 117 rather than an adjacent wire 20.

Figure 3:
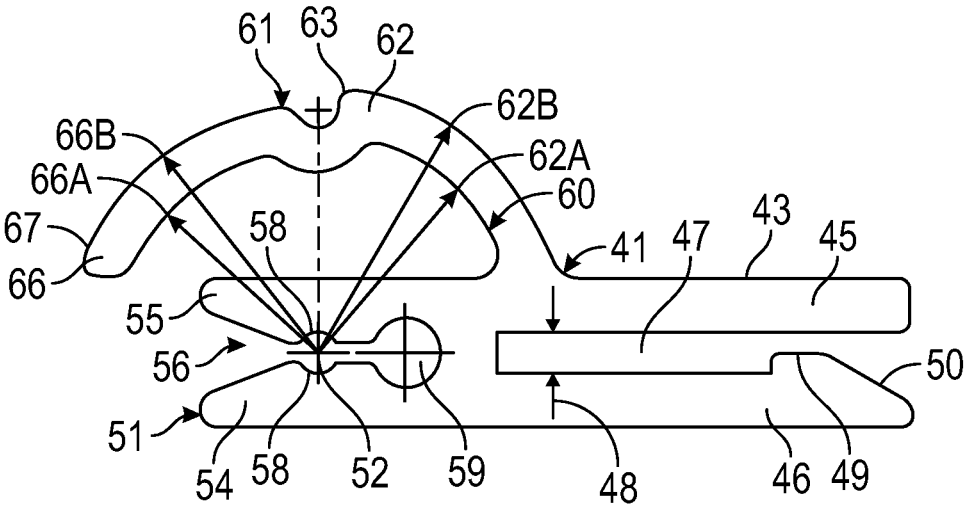
FIG. 3 is a side view of the hinge clip shown in FIG. 2.
Figure 4:
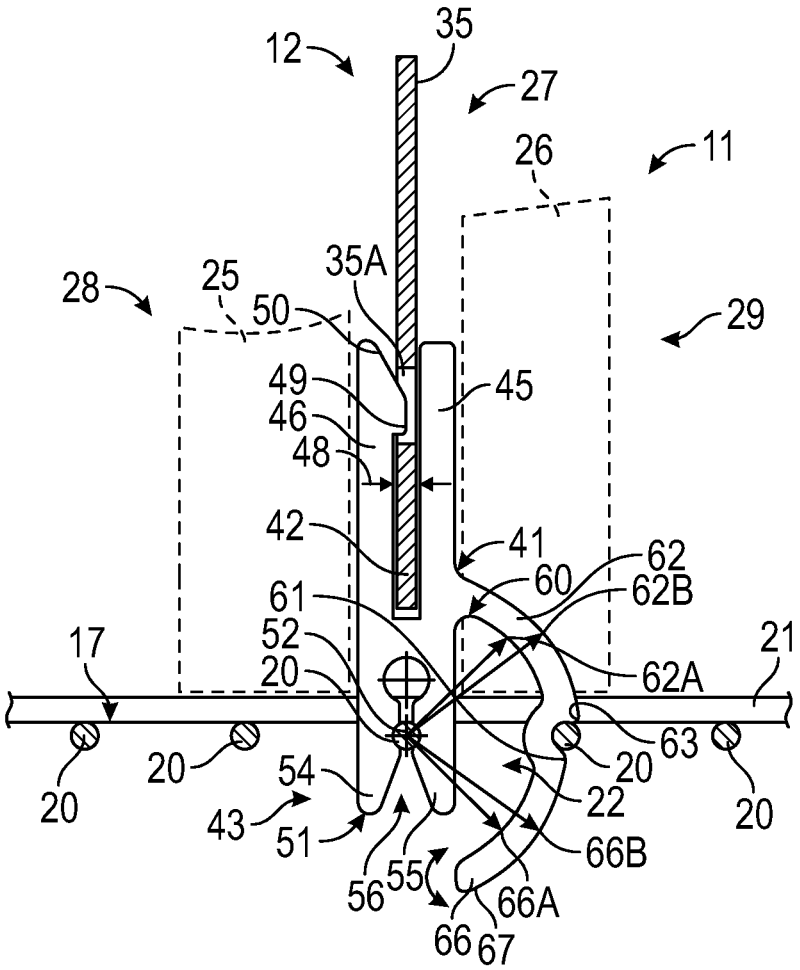
FIG. 4 is a side view of the hinge clip mounted to the divider panel.

As shown in FIGS. 3 and 4, hinge clip 43 has a mounting portion 44 which is comprised of a fixed jaw 45 and a deflectable jaw 46. The jaws 45 and 46 are spaced apart and define a mounting slot 47 between jaws 45,46. The slot 47 has a width 48 that is sized to tight-fittingly receive the bottom panel edge 42 therein. The deflectable jaw 46 includes a projection 49 adjacent a cam surface 50 which spreads the jaws 45 and 46 as the bottom panel edge 42 is slid into the slot 47. Once the projection 49 passes over the panel slot 35A, the projection 49 drops into the panel slot 35A and snap locks the hinge clip 43 to the panel unit 35.

Figure 2:
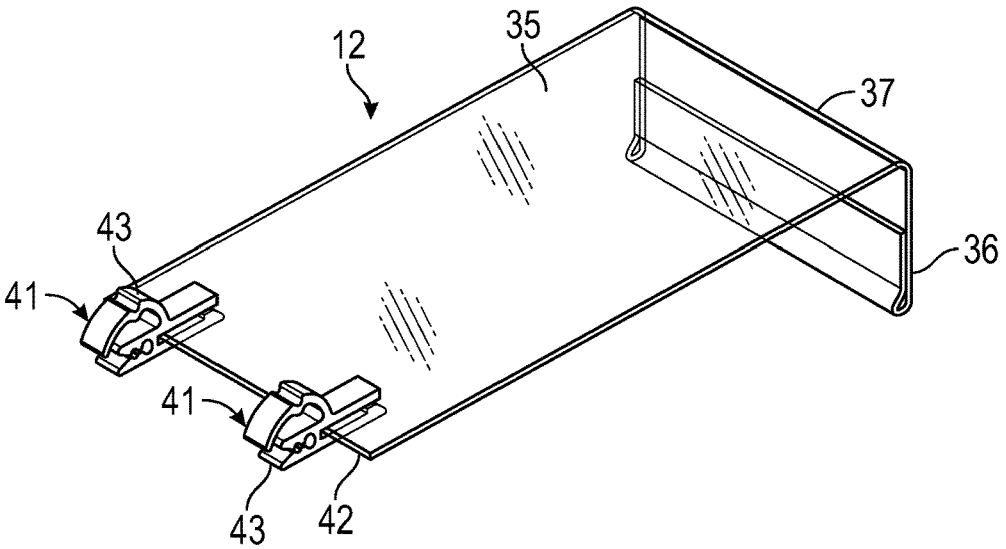
FIG. 2 is a perspective view of a divider unit for the inventory system having a hinge clip and a divider panel.

The divider unit 12 is now in the form of an assembly of the panel unit 35 and the hinge clips 43 as seen in FIG. 2. Each hinge clip 43 includes an engagement portion 51 at an end opposite to the mounting portion 44. The engagement portion 51 snap lockingly engages with a wire frame section forming the wire shelving and preferably connects to a lateral wire section (FIG. 4) so as to hingedly mount the display unit 12 to the wire shelving 10. The hinge clip 43 defines a hinge or pivot axis 52 about which the display unit 12 rotates. While the pivot axis 52 is preferably oriented horizontally and parallel to the front shelf edge 30, it is possible to snap the hinge clips 43 to a side wall 16 to define a vertical pivot axis.

The engagement portion 51 has a pair of resiliently deflectable connector jaws 54 which define a slot 55 and have inclined camming surfaces 56 which spread the jaws 54 when the wire section 20 is slid into the slot 55 to the seated position shown in FIG. 4. In this seated position, the hinge clip 43 rotates about the wire section 20.

Referring to FIG. 3, the inside surfaces of the jaws 54 include arcuate seats 58 which receive and rotatably seat the outside of the wire section 20. A flexure channel 59 is formed at the inner end of the slot 55 to facilitate flexing of the jaws 54. With this structure, the hinge clips 43 and associated divider unit 12 are snap locked onto the wire section 20.

Hinge clip 43 also includes a cantilevered locking member 60, which is resiliently deflectable and includes a locking portion or locking formation 61 that engages a lateral wire section 20 adjacent to the above-described wire section 20 that is fitted in the slot 56. This locking member 60 positively maintains the divider unit 12 in the upright position (FIG. 4) while allowing for free disengagement simply by an individual manually grasping the divider unit 12 and pulling same forwardly to a lowered position.

Locking member 60 is formed of a first section 62 which is dimensioned with a first inside radius 62A and outside radius 62B. The first section 62 terminates at the locking formation 61 which is formed as an arcuate seat and defines an abutment or stop 63. This stop 63 abuts against the wire section 20 and prevents further rearward rotation of the divider unit 12 past the first position.

The locking member 60 also includes a second section 66 that defines a terminal end and cam surface 67 that faces toward and abuts against the outer surface of the lateral wire section 20 to cause resilient deflection of the locking member 60. The second section 66 is dimensioned with a second inside radius 66A and outside radius 66B smaller than the first inside radius 62A and outside radius 62B. This radial difference allows sliding contact of the cam surface 67 with the wire section 20 to deflect the locking member 60 as it rotates into the mesh space 22 formed between two adjacent wire sections 20. The larger dimension of the first section 62 forms the stop 63 which defines the limit for rotation of the divider unit 12.

The recessed shape of the locking formation 61 seats the wire section 20 therein during panel rotation. As such, the hinge clip 43 provides for automatic positive locking of the divider unit 12 in the upright position, and allows for automatic release, simply by pulling the divider panel 12 forwardly. As another advantage, the hinge clip 43 allows for east snap locking engagement with the wire mesh to permit mounting to a new or original shelving system 10, and also allows for retrofit engagement of the divider unit 12 to any suitable wire frame structure by an installer. This provides an improved inventory system for use in various environments including healthcare environments.

Figure 5:
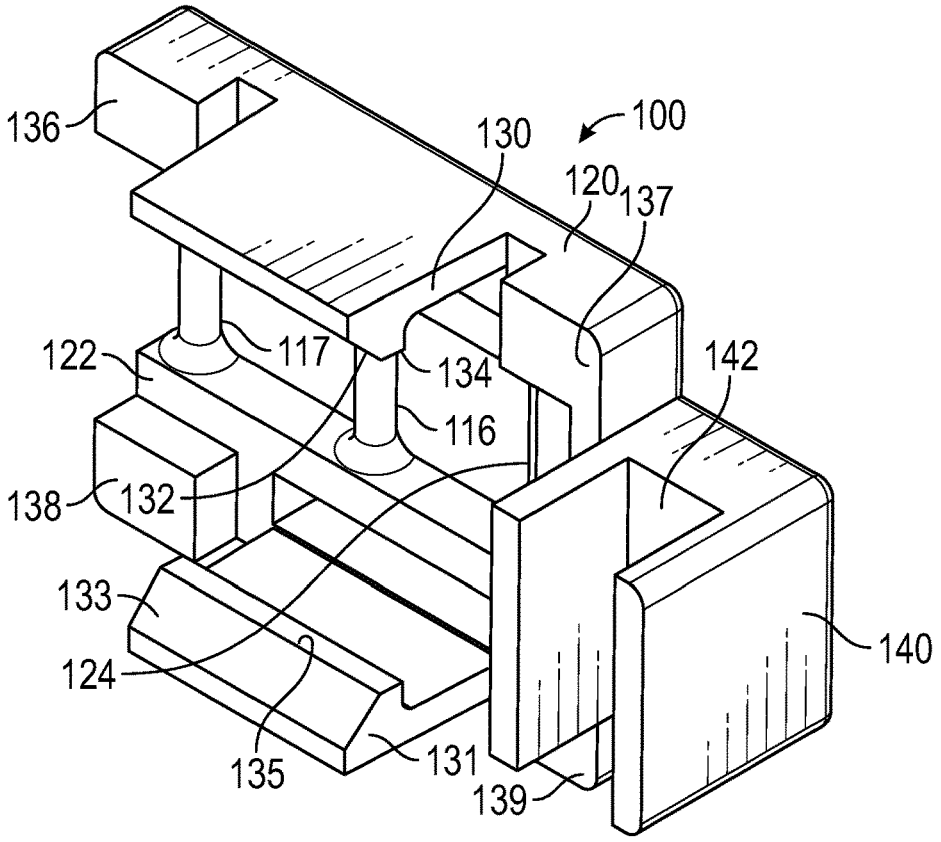
FIG. 5 is a perspective bottom view of the adaptor shown in FIG. 1.
Figure 6:
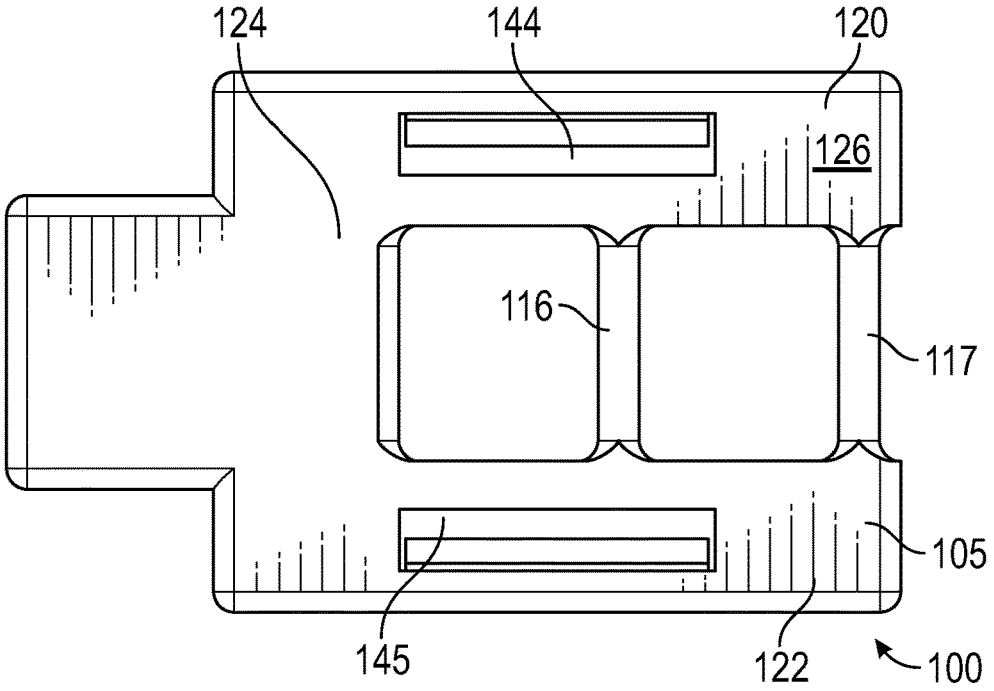
FIG. 6 is a top view of the adaptor shown in FIG. 1.

With reference to FIGS. 5 and 6, adaptor 100 comprises a frame 105 for supporting two simulated wires 116, 117 in parallel relationship. Simulated wires 116, 117 are spaced apart by a distance that can be the same or different from the spacing of wires 20.

Frame 105 generally includes a first side member 120 and a second side member 122 that is parallel with the first side member. The side members 120, 122 are spaced apart in fixed relationship to one another. In the illustrated embodiment, the fixed spacing between side members is maintained by a transverse member 124 that extends between and is connected with respective ends of side members 120, and by simulated wires 116, 117. In other embodiments, the fixed spaced relationship between side members 120, 122 can be maintained by the first simulated wire 116 alone, by the first simulated wire 116 and second simulated wire 117 together without the transverse member 124, or by first simulated wire 116 and transverse member 124 without second simulated wire 117.

Simulated wire 116 acts as an axle on which clip 43 can be pivotably mounted. Simulated wire 116 engages locking formations 61 of locking member 60 when divider unit 12 is mounted on adaptor 100 with the divider 35 in the upright position as shown in FIG. 4.

Extending downwardly with respect to upper surface 126 of adaptor 100 and from side members 120, 122 are opposing snap-fit connectors 130, 131 that allow adaptor 100 to be releasably secured to spaced apart parallel wires of a wire shelf. The adaptor can be injection molded using a strong and resilient polymeric material such as polypropylene, with the thickness of the snap-fit connectors being selected to facilitate resilient flexibility. Snap-fit connectors 130, 131 include ramped camming surfaces 132, 133 that engage spaced apart parallel wires of a wire shelf (e.g., adjacent parallel wires) during mounting of adaptor 100 on shelf 110. As adaptor 100 is pushed down onto shelf 110, wires 20 move along ramped surfaces 132, 133 causing distal sections of snap-fit connectors 130, 131 to flex outwardly away from each other, then along vertical surfaces 134, 135, and then finally past surfaces 134, 135 whereupon the distal ends of connectors 132, 133 resiliently return to their pre-flexed condition to releasably secure adaptor 100 to wires 20 between an upper horizontal ledge adjacent each of surfaces 134, 135 and associated raised wire engagement surfaces 136, 137, 138, 139 on the underside of the frame.

Adaptor 100 includes stabilizing formation 140 defining a downwardly facing U-shaped channel 142 configured to engage and retain a cross wire 114 of shelf 110. Stabilizing formation 140 provides resistance against adaptor 100 being dislodged from wire shelf 110 or moving along wires 20 when divider unit 12 is pivoted between the upright and lowered position.

In the illustrated embodiment, elongate apertures 144, 145 are provided to reduce torsional strain on side members 120, 122 during flexing of snap-fit connectors 130, 131 as adaptor 100 is being secured to wires 20 of wire shelf 110, and to enhance the resilient flexibility of connectors 130, 131.

Figure 7:
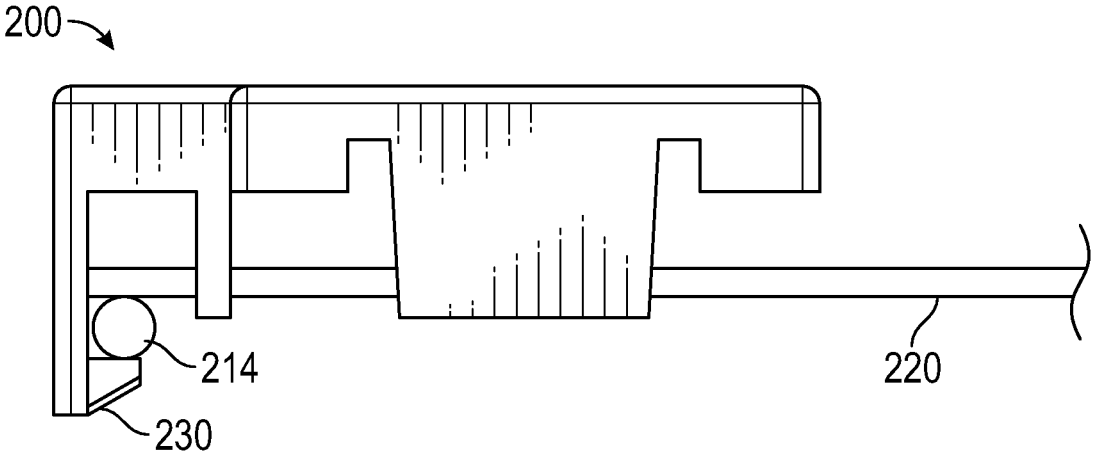
FIG. 7 is a side view of the adaptor mounted on a wire shelf.

FIG. 7 shows an embodiment 200 having a third snap-fit connector 230 for engaging a cross-wire 214 in order to provide a more secure and stable support structure for pivotable divider 12 (not shown in FIG. 7). Otherwise adaptor 200 is substantially similar to adaptor 100.

It is to be understood that the above description is intended to be illustrative and not restrictive. Many embodiments and applications other than the examples provided would be apparent upon reading the above description. The scope of the invention should be determined with reference to the appended claims along with the full scope of equivalents to which such claims are entitled. It is anticipated and intended that future developments will occur, and that the disclosed systems and methods will be incorporated into such future embodiments. In summary, it should be understood that the invention is capable of modification and variation.

What is claimed is:

1. A clip-on adaptor for pivotably supporting an inventory divider adapted to be pivoted around a wire of a wire-shelf, the adaptor facilitating pivoting of the inventory divider around an axis perpendicular to the length direction of the wires of the wire shelf, the adaptor comprising:

a frame having two spaced apart longitudinal members;

an axle attached at its opposite ends to the spaced apart longitudinal members, the axle configured to pivotably support the inventory divider;

a resiliently flexible clip dependent from each of the longitudinal members, the resiliently flexible clips configured for releasably engaging parallel wires of the wire-shelf;

a transverse member extending between and connected with the spaced apart longitudinal members; and a resiliently flexible clip dependent from the transverse member for releasably engaging a cross-wire of the wire-shelf.

2. The adaptor of claim 1, further comprising a simulated wire attached at its opposite ends to the spaced longitudinal member, the simulated wire being parallel with and spaced from the axle to provide engagement with a feature of the pivotable inventory divider to lock the pivotable divider in an upright position.

3. The adaptor of claim 1, wherein each of the resiliently flexible clips dependent from the longitudinal members have a hook configuration, including an angled camming surface extending proximally and inwardly from a distal end of the clip.

4. The adaptor of claim 1, wherein each flexible clip includes a ramped camming surface at an end distal from the longitudinal member from which the snap-fit connector extends.

5. The adaptor of claim 1, further comprising a stabilizing formation integral with the frame and defining a substantially U-shaped channel for engaging the wire shelf cross-wire extending transverse of the parallel wires.

6. The adaptor of claim 1, wherein each longitudinal member has an elongate opening adjacent to the associated flexible clip, whereby torsional strain on the side members is reduced during securement of the adaptor to the wire shelf.

7. The adaptor of claim 1, further comprising a second transverse member having a first section connected to the first longitudinal member and a second section connected to the second longitudinal member.

8. An inventory system comprising:

a wire shelf having a plurality of parallel uniformly spaced apart wires and at least one cross-wire oriented perpendicularly to the plurality of parallel wires;

an adaptor mounted on the wire shelf, the adaptor including a frame having two spaced apart longitudinal members; an axle attached at its opposite ends to the spaced apart longitudinal members, the axle configured to pivotably support the inventory divider; a resiliently flexible clip dependent from each of the longitudinal members, the resiliently flexible clips configured for releasably engaging parallel wires of the wire-shelf; a transverse member extending between and connected with the spaced apart longitudinal members; and a resiliently flexible clip dependent from the transverse member for releasably engaging a cross-wire of the wire-shelf; and a hinge clip removably mounted to the adaptor for rotation around the axle between an upright position and a lowered position.

9. The system of claim 8, wherein the hinge clip includes a releasable locking member that engages the simulated shelf wire to retain the hinge clip in the upright position.

10. The system of claim 8, wherein each flexible clip includes a ramped camming surface at an end distal from the longitudinal member from which the snap-fit connector extends.

11. The system of claim 8, further comprising a stabilizing formation integral with the frame and defining a substantially U-shaped channel for engaging the wire shelf cross-wire extending transverse of the parallel wires.

12. The system of claim 8, wherein each longitudinal member has an elongate opening adjacent to the associated flexible clip, whereby torsional strain on the side members is reduced during securement of the adaptor to the wire shelf.

13. The system of claim 8, further comprising a second transverse member having a first section connected to the first elongate member and a second section connected to the second elongate member.

* * * * *